US005819650A

United States Patent [19]

Shih

[11] Patent Number: 5,819,650

[45] Date of Patent: Oct. 13, 1998

[54] PRE-INK DIE-PLATE DATER

[76] Inventor: Shiny Shih, No. 31, Lane 349, Chungcheng S. Rd., Yungkang City, Tainan Hsien, Taiwan

[21] Appl. No.: 935,224

[22] Filed: Sep. 22, 1997

[51] Int. Cl.[6] ..... B41J 3/54; B41J 1/20

[52] U.S. Cl. ..... 101/111; 101/93.11

[58] Field of Search ..... 101/103, 104, 101/105, 106, 108, 93.11, 371, 109, 110, 111

[56] References Cited

U.S. PATENT DOCUMENTS

| | | | |
|---|---|---|---|
| 449,831 | 4/1891 | Smith | 101/111 |
| 668,021 | 2/1901 | Scotford | 101/105 |
| 794,800 | 7/1905 | Hill | 101/111 |
| 1,029,568 | 6/1912 | Folger et al. | 101/105 |
| 1,093,485 | 4/1914 | Scotford et al. | 101/111 |
| 1,401,436 | 12/1921 | Pannier | 101/105 |
| 2,088,009 | 7/1937 | Melind | 101/111 |
| 4,064,802 | 12/1977 | Funahashi | 101/371 |
| 4,492,162 | 1/1985 | Nettesheim et al. | 101/103 |
| 4,697,513 | 10/1987 | Faber | 101/111 |

*Primary Examiner*—Edgar S. Burr
*Assistant Examiner*—Leslie Grohusky
*Attorney, Agent, or Firm*—Kolisch Hartwell Dickinson McCormack & Heuser

[57] ABSTRACT

A pre-ink die-plate dater includes a casing having a bolt transversely extending therethrough to which at least one disk member is mounted, a die-plate rotatably reeved around a first shaft of the disk member and a second shaft, a bottom board pivotally connected to an underside of the casing and having an oblong opening defined therein so as to receive a stamping face of the die-plate therein. An adjusting member is disposed between the casing and the bottom board and connected to the bottom board by two screws. A distance between the bottom board and the adjusting member is adjusted by rotating the screws.

4 Claims, 7 Drawing Sheets

86. 8. 29

FIG.8
PRIOR ART

三 勝
86. 8. 29
收發文

FIG.9
PRIOR ART

PRE-INK DIE-PLATE DATER

BACKGROUND OF THE INVENTION

1. Field of the Invention

The present invention relates to a dater and, more particularly, to a pre-ink die-plate dater having an adjustable pedestal to adjust a distance between a stamping face and a surface to be stamped.

2. Brief Description of the Prior Art

There are two kinds of die-plate daters in the present market, one of which needs to be used with a stamp pad and the other is pre-ink. Those date-stamps are similar in appearances and usages. The first kind of daters has a plurality of rubber dies fixedly attached to a stamp face so that when stamping dates, a user adjusts the rubber dies to a proper position and stamps them on an ink pad and finally stamps a piece of paper. The pre-ink daters save a lot of time because no ink pads are needed as the rubber dies contain ink therein so that the user only stamps the dater directly. However, a distance between the stamping face and the paper to be stamped, and a force to stamp the piece of paper decide a stamping quality thereof. If the stamping face extends from the pedestal too far, infiltration could happen and the stamping face tends to be worn out quickly. Besides, ink will be used up very quickly if improper strength is applied to the stamping face. If the stamping face does not extend far enough from the pedestal, the result of the stamping will not be sufficiently clear.

FIG. 5 shows a first embodiment of a conventional pre-ink dater which includes a body 80 in which a disk 81 and four die-plates 82 are respectively disposed, and a pedestal 83 is fixedly connected to a bottom of the body 80. The die-plates 82 each have a stamping face 821 extending below the pedestal 83 and are rotated by rotating the disk 81. However, a distance between the stamping faces 821 and the pedestal 83 cannot be changed. FIG. 6 shows a second embodiment of the conventional pre-ink dater including a body 85 in which four die-plates 851 are disposed and a pedestal 86 below which stamping faces 87 extend. The pedestal 86 is connected to the body 85 by extending bolts 861 through the pedestal 86 to threadedly engage with a receiving member 852 disposed to both sides of the body 85. A relative distance between the pedestal 86 and the stamping faces 87 can be adjusted by operating the bolts 861 to changing a position of the pedestal 86. FIG. 7 shows a third embodiment of the conventional pre-ink dater including a body 90 in which four die-plates 93 together with four disks 931 are received and a pedestal 94 is disposed to a bottom of the body 90. The body 90 has a long slot 91 defined therein so as to receive a bolt 92 transversely through the four disks 931, the four die-plates 93 and the body 90 so that by adjusting the bolt 92, the positions of the four sets of die-plate 93 and the disk 931 are changed such that stamping faces 932 can be moved relative to the pedestal 94.

It is to be noted that the three embodiments of the conventional date-stamps can only show a date as shown in FIG. 8, which cannot meet requirements of users who need a date-stamp having other patterns or the like shown with the date such as shown in FIG. 9. If a stamping plate with a pattern is added to the conventional daters, it still needs an ink pad for the stamping plate.

The present invention intends to provide an improved pre-ink die-plate dater to mitigate and/or obviate the above-mentioned problems.

SUMMARY OF THE INVENTION

The present invention provides a pre-ink die-plate dater which includes a body having a casing from which a handle extends, a bottom board disposed to an underside of the casing and an adjusting member disposed between the casing and the bottom board. The casing has at least one slot defined in one of two sides thereof and two oblong holes respectively defined in two ends thereof. A bolt extends through the two oblong holes and has at least one disk member rotatably mounted thereto which partly extends from the slot. The disk member has a first shaft concentrically extending therefrom and a second shaft disposed near the underside of the casing so that a die-plate is reeved around the first and the second shaft. A passage is defined through a corner of the underside of the casing.

The bottom board has an oblong opening defined therethrough and two lugs extending upwardly therefrom so as to be pivotally connected to the casing by a pin which extends through the passage and the two lugs. Two blocks extend diametrically opposite from the bottom board and each have a screw hole defined therein. A fastening member is disposed to the bottom board and located diametrically opposite to the two lugs so as to disengagably attach the bottom board to the casing. At least one stamping plate is disposed to an underside of the bottom board and a stamping face of the die-plate extends from the oblong opening.

The adjusting member has a flange extending downwardly from a periphery thereof so as to receive the bottom board within a space enclosed by the flange. Two screws extend through the adjusting member and are respectively received in the screw holes so that a distance between the adjusting member and the bottom board is adjusted.

It is an object of the present invention to provide a pre-ink die-plate dater having a stamping plate and a rotatable stamping face.

It is another object of the present invention to provide a pre-ink die-plate dater wherein a distance from the stamping plate and the stamping face to an underside of the casing can be adjusted.

It is a further object of the present invention to provide a pre-ink die-plate dater effectively reduces infiltration when stamping.

It is still another object of the present invention to provide a pre-ink die-plate dater which reduces ink consumption thereof, Other objects, advantages, and novel features of the invention will become more apparent from the following detailed description when taken in conjunction with the accompanying drawings.

BRIEF DESCRIPTION OF THE DRAWINGS

FIG. 8 is an impression stamped by either one of the conventional daters shown in FIGS. 5 through 7, and FIG. 9 is an impression showing a date and other patterns.

DETAILED DESCRIPTION OF THE PREFERRED EMBODIMENTS

Figure 1:
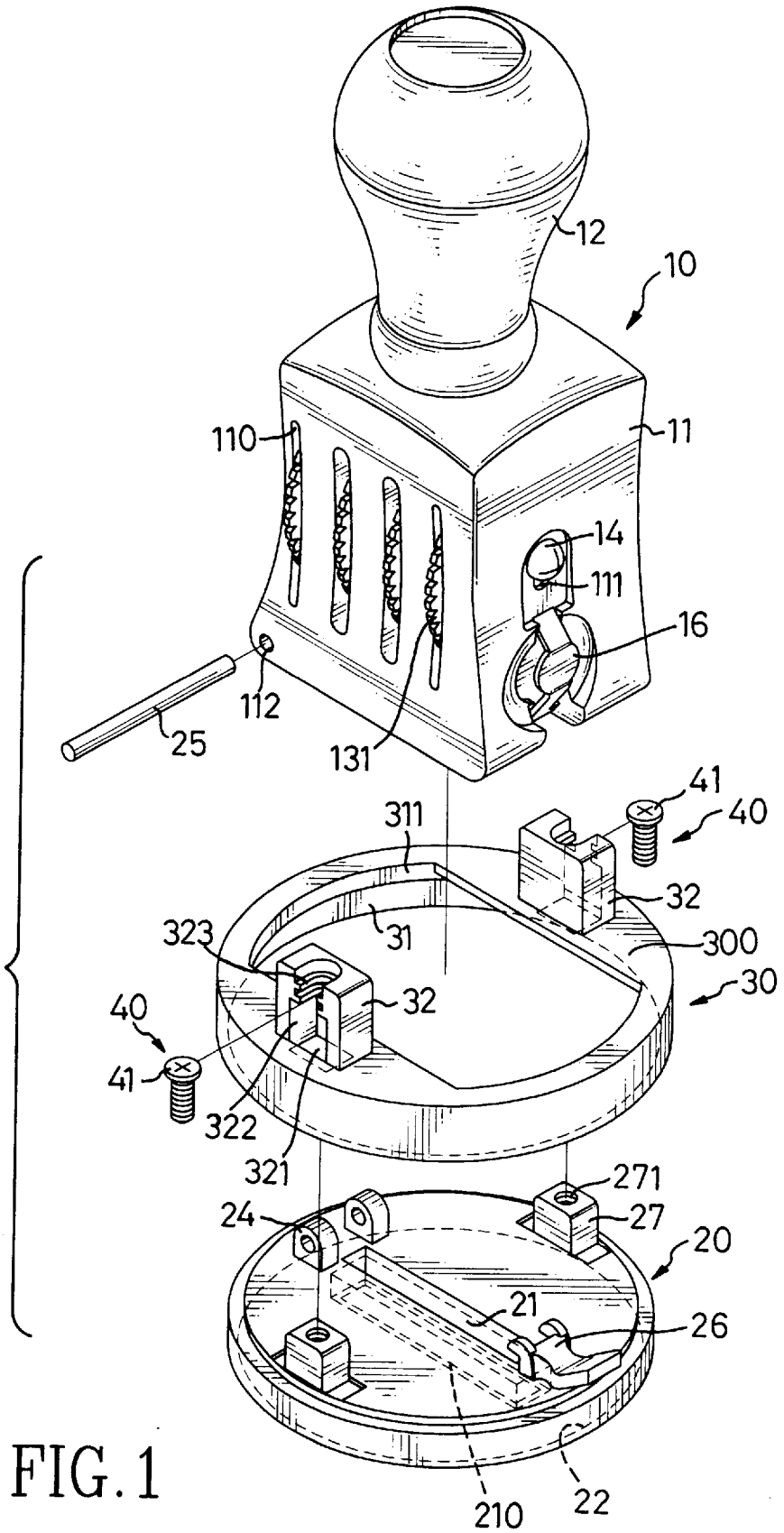
FIG. 1 is an exploded view of a pre-ink die-plate dater in accordance with the present invention.
Figure 2:
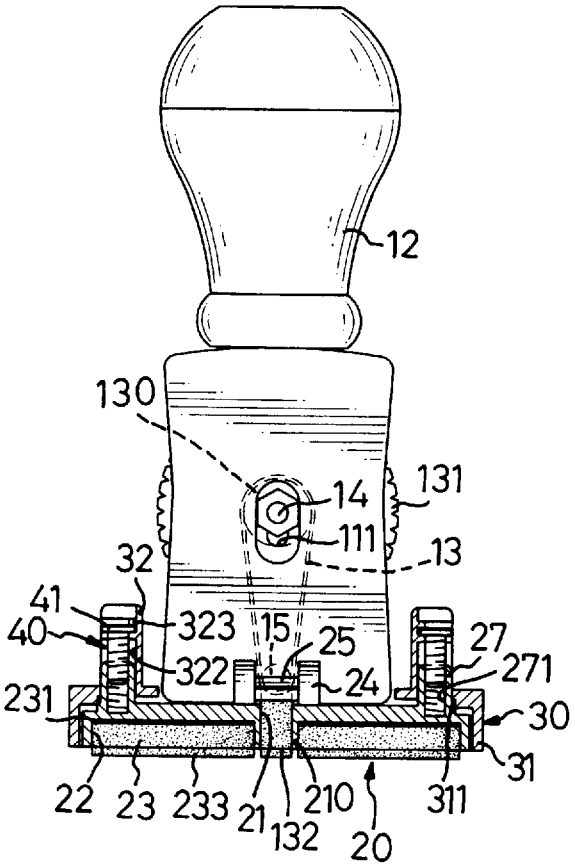
FIG. 2 is a side elevational view, partly in section, of the dater of the present invention when a stamping plate and face extend far from an adjusting member of the dater.

Referring to the drawings and initially to FIGS. 1 and 2, a pre-ink die-plate dater in accordance with the present invention generally includes a body 10 having a casing 11 and a handle 12 extending from a top of the casing 11. The casing 11 has four slots 110 defined in one of two sides thereof and two oblong holes 111 respectively defined in two ends thereof A bolt 14 extends through the two oblong holes 111. Four disk members 131 are rotatably mounted to the bolt 14 and the four disk members 131 respectively and partly extend from the slots 110. Each of the disk members 131 has a first shaft 130 concentrically extending therefrom. A second shaft 15 is disposed near an underside of the casing 11 Four die-plates 13 are reeved around the first shafts 130 and the second shaft 15. The casing 11 further has a curved plate 16 extending from one of two ends thereof. A passage 112 is defined through a corner of the underside of the casing 11 and located on an end opposite to the curved plate 16.

An adjustable pedestal includes a bottom board 20 and an adjusting member 30, wherein the bottom board 20 has an oblong opening 21 defined therethrough and two lugs 24 extend upwardly therefrom. The bottom board 20 is pivotally disposed to the underside of the casing 11 by extending a pin 25 through the passage 112 and the two lugs 24. Two blocks 27 extend diametrically opposite from the bottom board 20 and each have a screw hole 271 defined therein. A fastening member 26 being hook-like is disposed to the bottom board 20 and located diametrically opposite to the two lugs 24. The fastening member 26 is disengagably connected to the curved plate 16 of the casing 11. The bottom board 20 has a skirt portion 210 extending from the underside thereof along a periphery defining the oblong opening 21 so that stamping faces 132 of the die-plate 13 extend through the oblong opening 21 and are restricted within the skirt portion 210. A first flange 22 extends downwardly from a periphery of the bottom board 20 so that at least one stamping plate 23 is disposed to an underside of the bottom board 20, wherein the stamping plate 23 has patterns 233 other than numbers defined in an underside thereof which extends from a bottom peripheral edge of the first flange 22. An ink layer 231 is disposed between the stamping plate 23 and an inner side of the bottom board 20.

The adjusting member 30 is a ring member and has a hole 311 defined therein, and a second flange 31 extending downwardly from a periphery thereof so as to receive the bottom board 20 within a space enclosed by the second flange 31. The adjusting member 30 has two platforms 300 formed at a top thereof and a pair of protrusions 32 respectively extend from each one of the two platforms 300. Each of the platforms 300 has a aperture 321 defined therein and each of the protrusions 32 has a recess 322 defined laterally therein which communicates with the aperture 321 corresponding thereto. Two third flanges 323 extend transversely from an inner periphery defining the recess 322 so that the two blocks 27 are movably inserted in the recesses 322 via the apertures 321 respectively.

Two screws 40 are respectively and rotatably inserted into the recesses 322 with a respective head 41 thereof rotatably received between the two third flanges 323 corresponding thereto. The screws 40 are respectively received in the screw holes 271 so that a distance measured from the patterns 233 of the stamping plate 23 and the stamping faces 132 to the bottom peripheral edge of the first flange 22 is adjustable.

Figure 3:
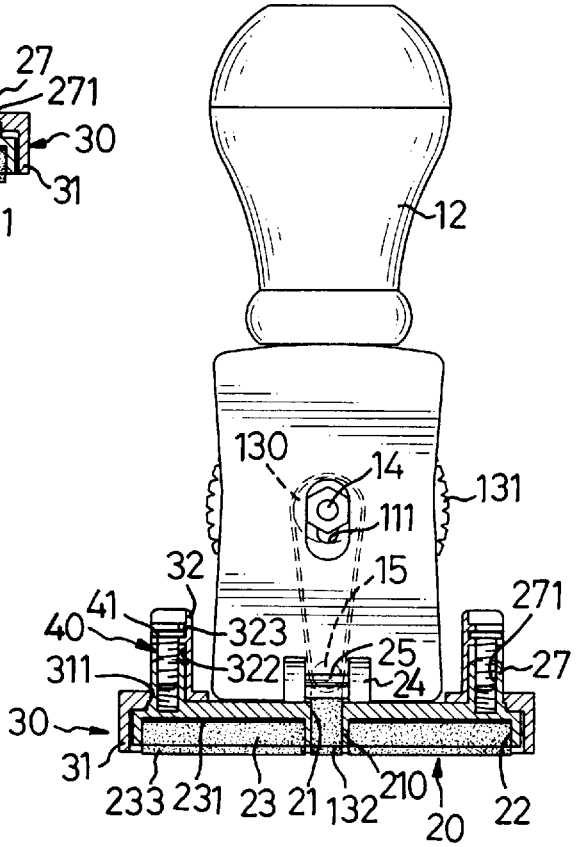
FIG. 3 is a side elevational view, partly in section, of the dater of the present invention when a distance from the stamping plate and face to the adjusting member is adjusted shorter than that shown in FIG. 2.

Referring to FIG. 3, if a user wants to reduce the distance measured from the patterns 233 of the stamping plate 23 and the stamping faces 132 to the bottom peripheral edge of the first flange 22, the screws 40 are simply rotated so that the adjusting member 30 is lowered or raised.

Therefore, the distance mentioned above can be adjusted according to needs of the users so as to have a clear stamping result.

Figure 4:
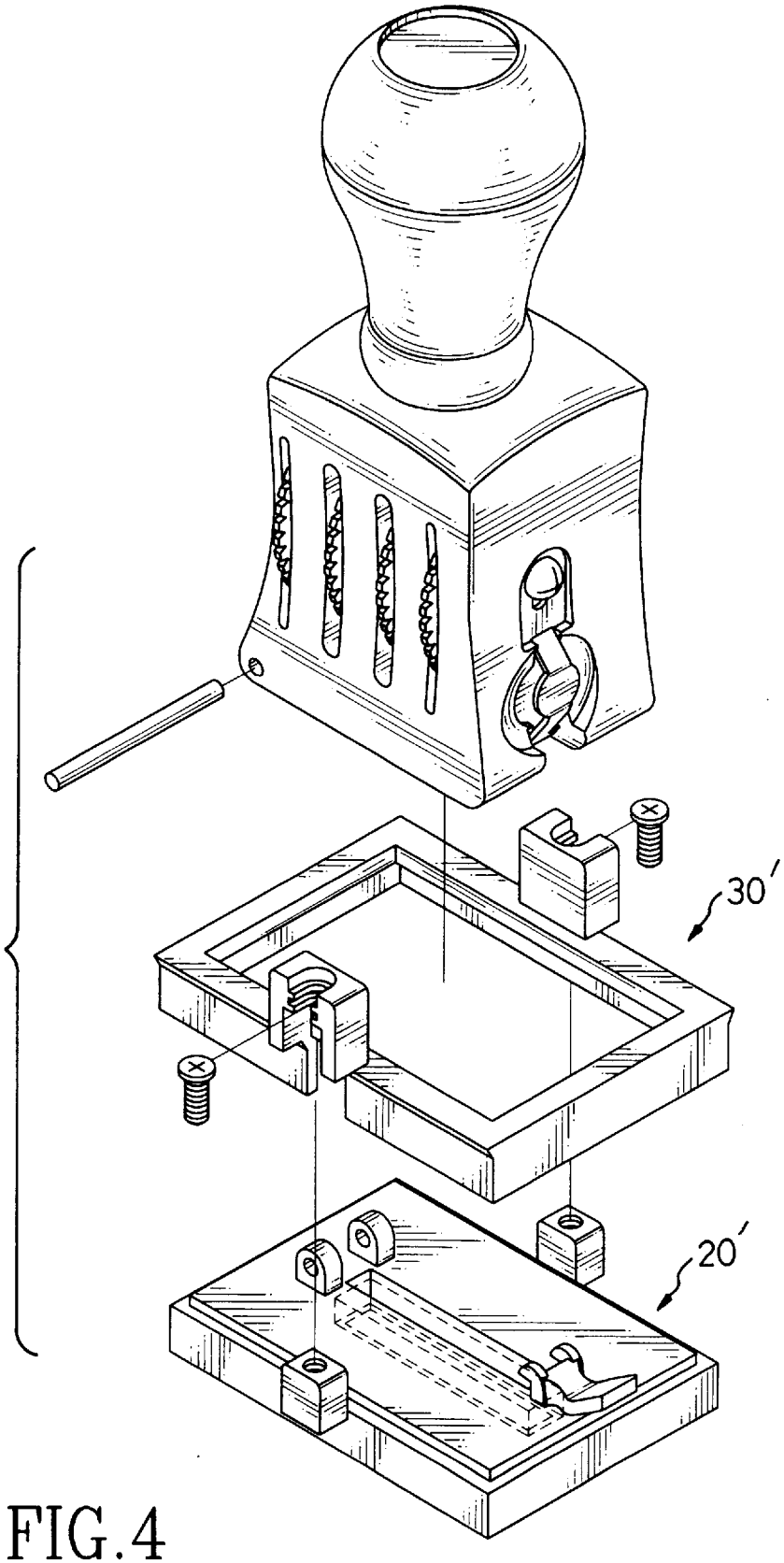
FIG. 4 is an exploded view of a second embodiment of the pre-ink die-plate dater in accordance with the present invention.
Figure 5:
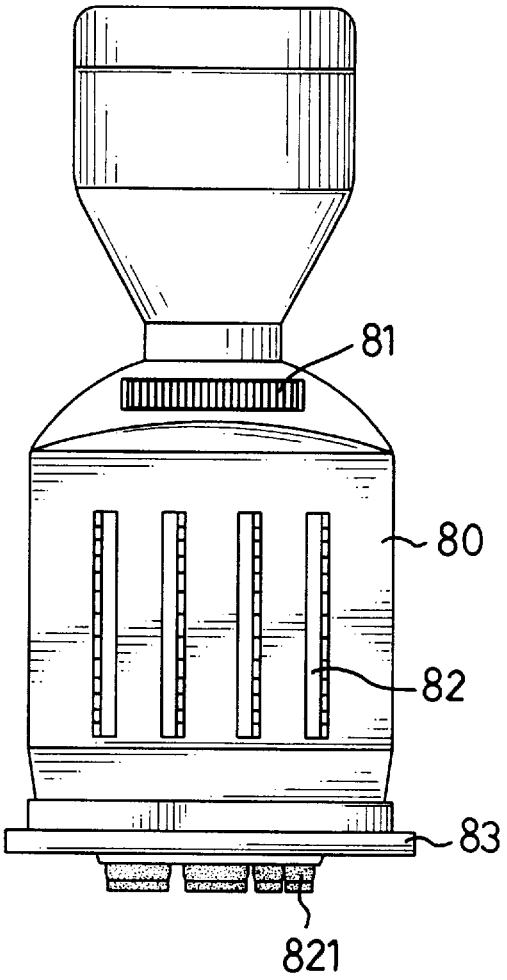
FIG.5 PRIOR ART
FIG. 5 is a side elevational view of a first embodiment of a conventional dater.
Figure 6:
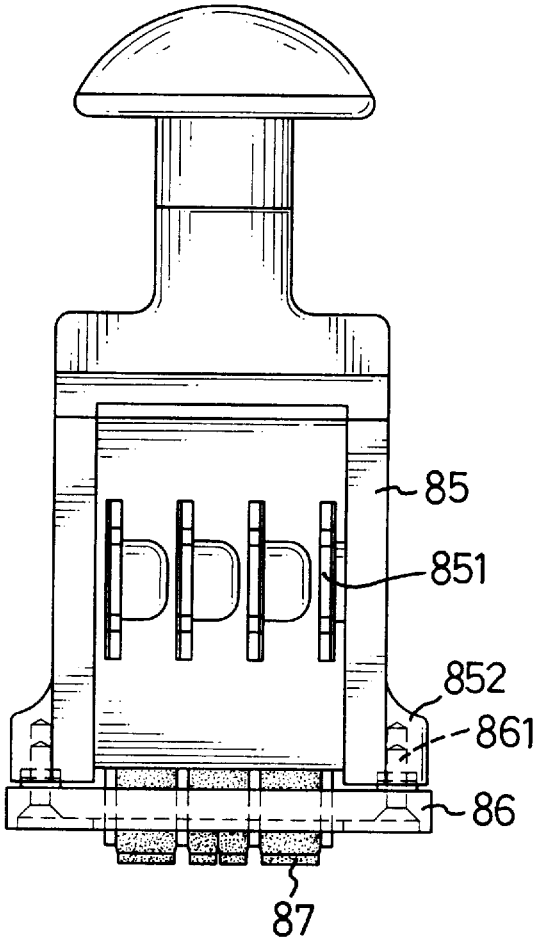
FIG.6 PRIOR ART
FIG. 6 is a side elevational view of a second embodiment of a conventional dater.
Figure 7:
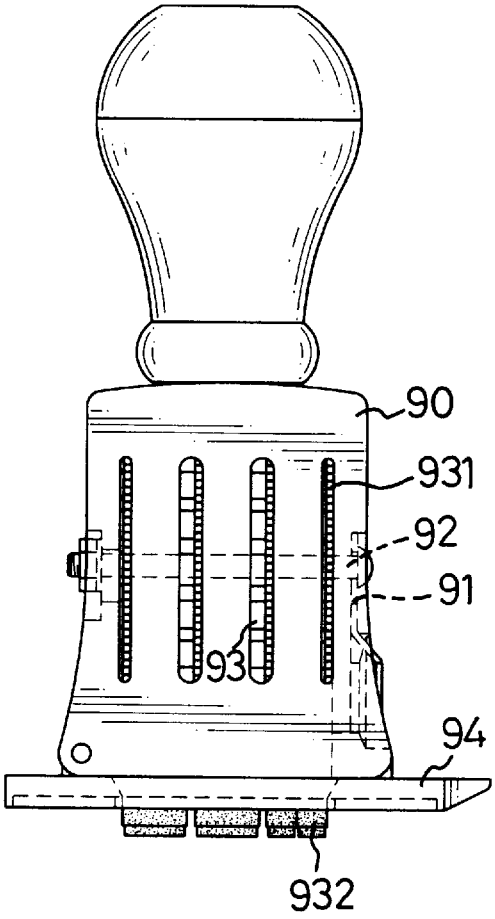
FIG.7 PRIOR ART
FIG. 7 is a side elevational view of a third embodiment of a conventional dater.

FIG. 4 shows a second embodiment of the dater of the present invention wherein the bottom board 20' and the adjusting member 30' are both rectangular in shape. Any desired shape of the bottom board 20 and the adjusting member 30 can be made when needed.

Accordingly, advantages of the present invention are as follows:

(1). The new adjustable design provides a height adjustable pedestal which is used to adjust and set the distance measured from the patterns 233 of the stamping plate 23 and the stamping faces 132 to the bottom-peripheral edge of the first flange 22. Users need not worry about a force which they apply to the dater when stamping paper, etc. This unique function is designed to reduce improper strength applied on the dater and prevent abnormal wear resulting from improper force so that a term of usage of the dater can be extended.

(2). The adjustable pedestal allows an easy control of consumption of ink and a filtration.

(3). The adjustable pedestal enables use of the dater without any worry about stamping force and so a best impression can be achieved.

(4). The changes of temperature may cause the shrink or expansion on the die-plate. If, after a period of time, the die-plate becomes worn because of prolonged usage, the customers can adjust the die-plate to avoid the above mentioned problems so as to have a long term of usage.

Although the invention has been explained in relation to its preferred embodiment, it is to be understood that many other possible modifications and variations can be made without departing from the spirit and scope of the invention as hereinafter claimed.

What is claimed is:

1. A pre-ink die-plate dater comprising:

a body having a casing and a handle extending from a top of said casing, said casing having at least one slot defined in one of two sides thereof and two oblong holes respectively defined in two ends thereof, a bolt extending through said two oblong holes and having at least one disk member rotatably mounted thereto which partly extends from said slot, said disk member having a first shaft concentrically extending therefrom and a second shaft disposed near an underside of said casing, a die-plate reeved around said first and said second shaft, a passage defined through a corner of said underside of said casing;

a bottom board having an oblong opening defined therethrough and two lugs extending upwardly therefrom, said bottom board being pivotally disposed to said underside of said casing by a pin extending through said passage and said two lugs, two blocks extending diametrically opposite from said bottom board and each having a screw hole defined therein, a fastening member disposed to said bottom board and located diametrically opposite to said two lugs, by said fastening member said bottom board being disengagably attached to said casing;

at least one stamping plate disposed to an underside of said bottom board and a stamping face of said die-plate extending from said oblong opening, and an adjusting member having a hole defined therein and a flange extending downwardly from a periphery thereof said bottom board being received within a space enclosed by said flange, two screws respectively extending through said screw holes, a distance between said adjusting member and said bottom board being adjustable by rotation of said screws.

2. The pre-ink die-plate dater as claimed in claim 1 wherein said casing has a curved plate extending from one of two ends thereof and said fastening member is a hook-like member which is disengagably connected to said curved plate.

3. The pre-ink die-plate dater as claimed in claim 1 wherein said adjusting member has two protrusions extending therefrom and each of which has a recess defined laterally therein, two flanges extending transversely from an inner periphery defining said recess so that said two blocks are movably inserted in said recesses, said screws each having a head thereof rotatably received between said two flanges corresponding thereto.

4. The pre-ink die-plate dater as claimed in claim 1 wherein said bottom board has a skirt portion extending from said underside thereof along a periphery defining said oblong opening, said stamping face of said die-plate extending within said skirt portion.

* * * * *